US007697018B2

(12) United States Patent
Shishikura

(10) Patent No.: US 7,697,018 B2
(45) Date of Patent: Apr. 13, 2010

(54) IMAGE FORMING APPARATUS, IMAGE FORMING METHOD AND IMAGE FORMING PROGRAM

(75) Inventor: Kenichiro Shishikura, Namazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 461 days.

(21) Appl. No.: 11/380,896

(22) Filed: Apr. 28, 2006

(65) Prior Publication Data

US 2006/0290766 A1 Dec. 28, 2006

(30) Foreign Application Priority Data

Jun. 27, 2005 (JP) ..... 2005-185903

(51) Int. Cl.
*B41J 2/385* (2006.01)
*B41J 2/47* (2006.01)
*G03G 15/01* (2006.01)

(52) U.S. Cl. ..... 347/116; 347/234; 399/301

(58) Field of Classification Search ..... None
See application file for complete search history.

(56) References Cited

U.S. PATENT DOCUMENTS 6,204,866 B1 * 3/2001 Yonenaga ..... 347/116
6,341,205 B1 * 1/2002 Yoshino et al. ..... 399/101
6,519,425 B2 * 2/2003 Fischer ..... 399/49

FOREIGN PATENT DOCUMENTS

JP 7-52468 8/1993

* cited by examiner

*Primary Examiner*—Matthew Luu
*Assistant Examiner*—Kendrick X Liu
(74) *Attorney, Agent, or Firm*—SoCal IP Law Group LLP; Steven C. Sereboff; M. Kala Sarvaiya

(57) ABSTRACT

A technique can define a right position for forming a toner image on the transfer surface of an intermediate transfer body regardless of the size and the number of the sheets on which toner images are to be transferred. An image forming apparatus for forming a toner image on the transfer surface of an intermediate transfer body by correcting the position for forming the toner image comprises a data acquisition section that acquires predetermined data relating to the printing data for forming an image on a sheet and a correction section that corrects the predefined value for defining the position for forming the toner image on the transfer surface according to a predetermined correction value corresponding to the predetermined data acquired in the data acquisition section. Upon determining that toner images are formed simultaneously on the transfer surface for a plurality of pages according to the predetermined data, the correction section corrects the respective positions for forming the toner images, using the correction values respectively corresponding to the plurality of pages.

12 Claims, 7 Drawing Sheets

| IMAGE OF 1 SHEET IS TO BE FORMED | IMAGE OF 2 SHEETS ARE TO BE FORMED |
|---|---|
| A3/LD | A4/LT |
| B4/LG | B5 |
| A4-R/LT-R | A5-R/ST-R |
| B5-R | |

IMAGE FORMING APPARATUS, IMAGE FORMING METHOD AND IMAGE FORMING PROGRAM

BACKGROUND OF THE INVENTION

1. Field of the Invention

This invention relates to a technique of forming an image by correcting the position of forming a toner image on the transfer surface of an intermediate transfer body.

2. Description of the Related Art

In an image forming apparatus designed to transfer a toner image formed on the transfer surface of an intermediate transfer body onto a sheet of paper, the position where the toner image is formed on the transfer surface of the intermediate transfer body needs to be correct because it directly affects the position to which the toner image is to be transferred onto the sheet of paper (the image position on the page of the sheet) is actually transferred from the intermediate transfer body onto the sheet.

When forming an image by means of a plurality of toners of different colors (e.g., black (K), cyan (C), magenta (M) and yellow (Y)), it is necessary to make the positions to which the toner images of the different colors are transferred correct and appropriate relative to each other (color superimposition) because a so-called color shift (a degraded image) appears if the toner images of the different colors are displaced from each other on the surface to which the toner images are transferred as shown in FIG. 4 of the accompanying drawings.

Because of the importance of the positions for forming toner images on the transfer surface of an intermediate transfer body, techniques for correcting the positions for forming toner images on the transfer surface have been proposed (see, inter alia, Patent Document 1: Jpn. Pat. Appln. Laid-Open Publication No. 2003-333607).

The technique of the above-cited Patent Document 1 is for improving the accuracy of the positions for forming toner images on the transfer surface by detecting the quantity of displacement of the image forming position of the toner image of each of the colors (in the direction of moving a sheet of paper) on the transfer surface and regulating (correcting) the timing of forming a corresponding image on a photosensitive body according to the detected quantity.

Meanwhile, in the case of an image forming apparatus adapted to form an image on a long-sized sheet of paper (A3/LD, etc.) and also on a short-sized sheet of paper (A4/LT, etc), a long toner image is formed at a time on the transfer surface for a long-sized page if images of a plurality of pages are to be formed in an image forming operation, whereas two or more than two toner images are formed at a time on the transfer surface for so many short-sized pages if images of a plurality of pages are to be formed in an image forming operation typically as shown in FIG. 5. FIG. 6 illustrates an example of classification of sheet sizes for a group of sheet sizes for which toner images are formed simultaneously on an intermediate transfer body for two pages and a group of sheet sizes for which only a toner image is formed on an intermediate transfer body for a single page.

FIG. 7 illustrates a conventional method of correcting the positions for forming toner images on the transfer surface of an intermediate transfer body for short-sized sheets of paper and also for long-sized sheets of paper. The operation of correcting the positions for forming toner images starts with the toner image that corresponds to the first page and, when the position of the toner image of the first page is corrected, the operation proceeds to correct the position for forming the toner image that corresponds to the second page.

Referring to an upper part of FIG. 7, assume that the toner image (for the first sheet of paper) of the first page is transferred onto the transfer surface of an intermediate transfer body for a long-sized sheet of paper (e.g., A3 size sheet). When the toner image (for the second sheet of paper) of the second page is transferred onto the transfer surface, the position for forming the toner image is corrected by using a correction value for the second page that is different from the correction value used for the first page.

The correction value for the first page differs from the correction value for the second and subsequent pages probably because the abutment of the intermediate transfer belt cleaner and the timing of abutment for the secondary transfer for the second or some other page differ from those of the first page (difference of printing sequence). Since the pages that come after the second page follows the sequence same as that of the second page for the causes of color shift, the correction value that is used for the second page is also used for those pages.

As pointed out above, with the conventional method for correcting the color shift, only the correction value for long-sized sheets of paper such as A3 size sheets that are frequently consumed is defined in advance and generally utilized also when forming images on sheets of paper of other sizes. Toner images of two pages are formed at the same time on the transfer surface of an intermediate transfer body when forming images on short-sized sheets of paper (e.g. A4 size sheets) and the position of one of the toner images, or the toner image for the first page, is corrected and the applied correction value that is used for the first page is also used for the second page without correcting the correction value.

The transfer bias (primary transfer bias) that is applied when transferring a toner image (for a primary transfer) from the photosensitive surface of a photosensitive body onto an intermediate transfer body is common to both long-sized sheets and short-sized sheets of paper and always output in each cycle of operation from the time of starting an operation of forming a number of toner images on the transfer surface of the intermediate transfer body simultaneously to the time of ending the operation of forming the images on the transfer surface (to be referred to as image forming cycle hereinafter) (see FIG. 7).

However, when forming two toner images on the transfer surface at a time for so many short-sized sheets of paper, a blank space is produced between the toner images for preceding pages (the first sheet and the third sheet of A4 size in FIG. 8) and the toner images for the immediately succeeding respective pages (the second sheet and the fourth sheet of A4 size in FIG. 8) and no image is formed in the blank space separating any two consecutive toner images.

It is known that the intermediate transfer body and the photosensitive surface of the photosensitive body are adsorbed each other by electrostatic force. It is also known that the adsorptivity is affected by the type of the toner image to be transferred and the presence or absence of a formed toner image. Thus, when forming short-sized toner images, the behaviors of the toner images of each color fluctuate under the influence of electrostatic adsorption due to the blank space where no toner exists. Therefore, when forming toner images on the transfer surface of an intermediate transfer body for a plurality of pages at a time, the positions for forming the toner images that corresponds to the second and subsequent pages (or to the second and the fourth sheets of A4 size in FIG. 8) are adversely affected (to give rise to color shifts).

Additionally, when the length of a long-sized sheet and that of two short-sized sheets plus an inter-sheet gap are compared, the latter is longer than the former as a matter of course. In other words, a blank space follows the length of a long-sized sheet on the transfer surface of an intermediate transfer body. Thus, the behavior of the leading end of a toner image for a long-sized sheet (which corresponds to the second sheet of A3 size in FIG. 8) differs from that of the leading end of a toner image for a former page of a short-sized sheet (which corresponds to the first sheet or the third sheet of A4 size in FIG. 8).

SUMMARY OF THE INVENTION

The present invention is intended to dissolve the above-identified problems. Therefore, it is the object of the present invention to provide a technique for defining a right position for forming a toner image on the transfer surface of an intermediate transfer body regardless of the size and the number of the sheets on which toner images are to be transferred.

In an aspect of the present invention, the above problems are dissolved by providing an image forming apparatus for forming a toner image on the transfer surface of an intermediate transfer body, correcting the position for forming the toner image, the apparatus comprising: a data acquisition section that acquires predetermined data relating to the printing data for forming an image on a sheet; and a correction section that corrects the predefined value for defining the position for forming the toner image on the transfer surface according to a predetermined correction value corresponding to the predetermined data acquired in the data acquisition section; upon determining that toner images are formed simultaneously on the transfer surface for a plurality of pages according to the predetermined data, the correction section correcting the respective positions for forming the toner images, using the correction values respectively corresponding to the plurality of pages.

In another aspect of the present invention, there is provided an image forming method for forming a toner image on the transfer surface of an intermediate transfer body, correcting the position for forming the toner image, the method comprising: a data acquisition step that acquires predetermined data relating to the printing data for forming an image on a sheet; and a correction step that corrects the predefined value for defining the position for forming the toner image on the transfer surface according to a predetermined correction value corresponding to the predetermined data acquired in the data acquisition step; upon determining that toner images are formed simultaneously on the transfer surface for a plurality of pages according to the predetermined data, the correction step correcting the respective positions for forming the toner images, using the correction values respectively corresponding to the plurality of pages.

In still another aspect of the present invention, there is provided an image forming program for causing a computer to execute a method for forming a toner image on the transfer surface of an intermediate transfer body, correcting the position for forming the toner image, the program comprising: a data acquisition step that acquires predetermined data relating to the printing data for forming an image on a sheet; and a correction step that corrects the predefined value for defining the position for forming the toner image on the transfer surface according to a predetermined correction value corresponding to the predetermined data acquired in the data acquisition step; upon determining that toner images are formed simultaneously on the transfer surface for a plurality of pages according to the predetermined data, the correction step correcting the respective positions for forming the toner images, using the correction values respectively corresponding to the plurality of pages.

As described above in detail, according to the present invention, it is possible to provide a technique for defining a right position for forming a toner image on the transfer surface of an intermediate transfer body regardless of the size and the number of the sheets on which toner images are to be transferred.

DETAILED DESCRIPTION OF THE PREFERRED EMBODIMENTS

Now, the present invention will be described by referring to the accompanying drawings that illustrate a preferred embodiment of the invention.

Figure 1:
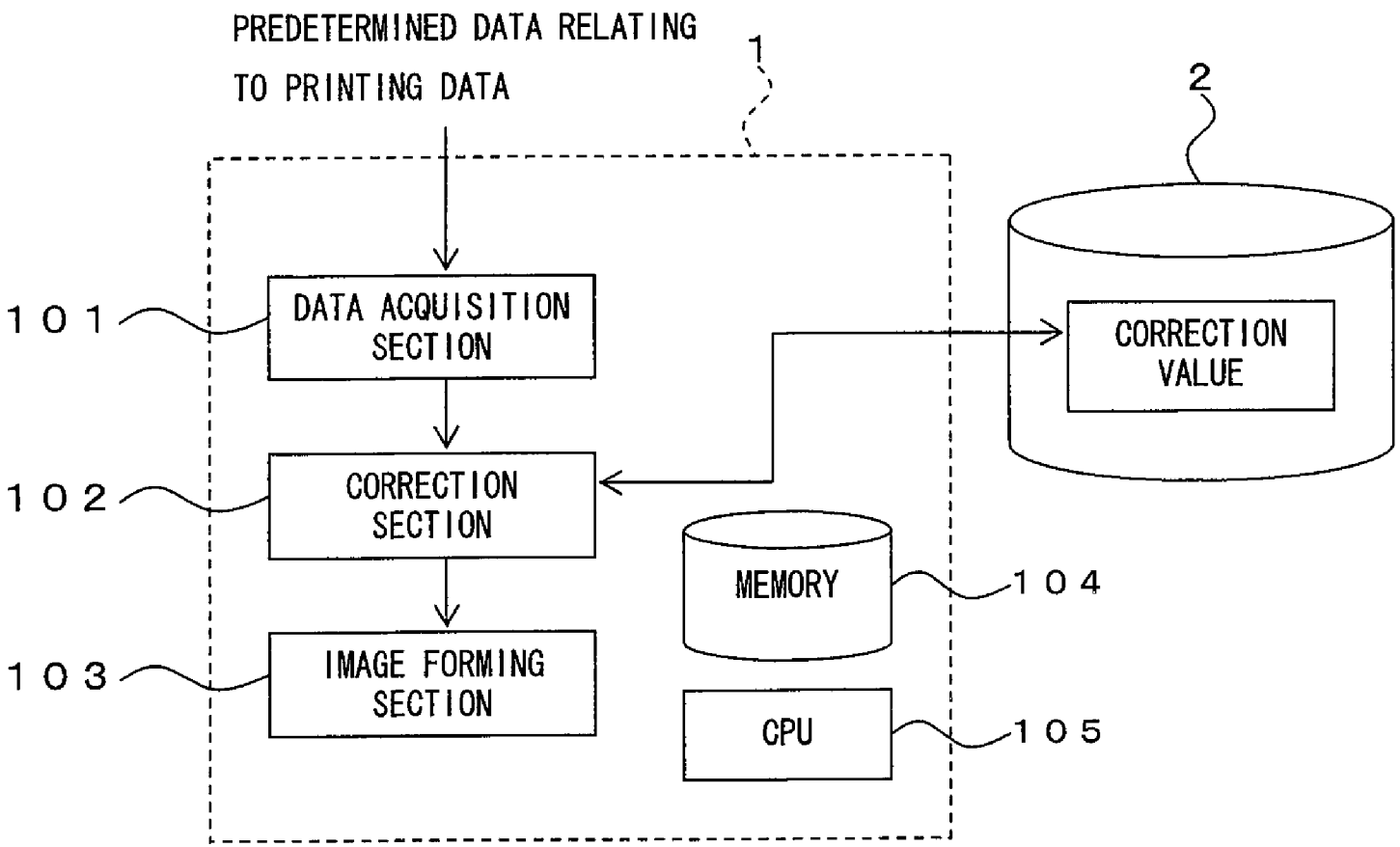
FIG. 1 is a schematic functional block diagram of an embodiment of image forming apparatus according to the invention.

FIG. 1 is a schematic functional block diagram of the embodiment of image forming apparatus of the invention.

Referring to FIG. 1, the image forming apparatus 1 of this embodiment typically comprises an MFP (Multi-Function Peripheral) and is connected to a database 2 by way of a telecommunication line such as a LAN so as to be communicable with the latter.

More specifically, the image forming apparatus 1 comprises a data acquisition section 101, a correction section 102, an image forming section 103, a memory 104 and a CPU 105.

The data acquisition section 101 takes a role of acquiring predetermined data relating to the printing data for forming an image on a sheet. Printing data as used herein refer to data necessary for the image forming section 103 of the image forming apparatus 1 to execute an image forming process. More specifically, such data are transmitted to the image forming section 103 for the purpose of executing a copying process according to the image data read out by an image reading section (not shown) or receiving a printing instruction from an external appliance such as PC communicably connected to the image forming apparatus 1. Predetermined data relating to printing data as used herein typically indicate the size and the number of the sheets and the types of toners (toners of what colors are to be used for forming an image) to be used for the coming image forming process.

The correction section 102 takes a role of correcting the predefined value for defining the position for forming a toner image on a transfer surface according to the predetermined correction value that corresponds to the predetermined data acquired by the data acquisition section 101. More specifically, when it is determined that a plurality of toner images are to be formed simultaneously on the transfer surface of an intermediate transfer body for so many pages according to the predetermined data, the correction section 102 corrects the position for forming the toner image of each of the plurality of pages by using a corresponding correction value. Note that the predetermined value to be used for correcting a position by the correction section 102 is stored typically in the memory 104.

The image forming section 103 takes a role of forming one or more than one toner images on a sheet of paper. More specifically, it is adapted to form an electrostatic latent image by scanning the photosensitive surface of a photosensitive body by means of a laser beam and transfers the toner image produced by visualizing the electrostatic latent image to a sheet. The correction section 102 corrects the position for forming a toner image on a transfer surface by adjusting the currently defined timing of emitting a laser beam onto the photosensitive surface of the image forming section 103 for the purpose of forming a toner image on the transfer surface according to the instruction issued from the correction section 102. While an intermediate transfer belt is adopted as intermediate transfer body to be used for transferring the toner image formed on the transfer surface onto a sheet in this embodiment, the present invention is by no means limited thereto and an intermediate transfer roller may alternatively be adopted for the purpose of transferring a toner image onto a sheet.

The CPU 105 takes a role of executing various processes in the image forming apparatus and a role of realizing various functional features by executing the corresponding programs stored in the memory 104. The memory 104 typically comprises a ROM and a RAM and takes a role of storing various pieces of information and various programs to be utilized by the image forming apparatus.

Thus, the image forming apparatus of this embodiment having the above-described configuration forms an image by correcting the position for forming the corresponding toner image on the transfer surface of an intermediate transfer body.

The database 2 typically comprises an HDD and takes a role of storing the above-described predetermined correction values. A predetermined correction value that is stored in the database 2 may be a value relating to the position on a sheet to which a toner image is to be transferred (e.g., the toner image position on the sheet) or, when a plurality of toner images are formed on the transfer surface by using toners of a plurality of different colors, a value relating to the relative positions of the toner images of the different colors (the correction value relating the color shift among the toner images of the different colors).

The above-described known technique typically uses correction values that correspond to toners of different colors as defined for long-sized sheets for the purpose of correcting the color shift of the toner images to be formed on the transfer surface of an intermediate transfer body.

1st to-be-printed black letter correction value: K1

1st to-be-printed cyan letter correction value: C1

1st to-be-printed magenta letter correction value: M1

1st to-be-printed yellow letter correction value: Y1

2nd to-be-printed black letter correction value: K2

2nd to-be-printed cyan letter correction value: C2

2nd to-be-printed magenta letter correction value: M2

2nd to-be-printed yellow letter correction value: Y2

Any of above listed K1 through Y2 typically takes a numerical value between 0 and 255.

In this embodiment, the third through sixth correction values are provided in addition to the above listed conventional first and second correction values (K1 through Y2). Thus, this embodiment has the following correction values that can accommodate each page to be printed and each color to be printed for the purpose of correcting color shifts.

1st to-be-printed black letter correction value: K1

1st to-be-printed cyan letter correction value: C1

1st to-be-printed magenta letter correction value: M1

1st to-be-printed yellow letter correction value: Y1

2nd to-be-printed black letter correction value: K2

2nd to-be-printed cyan letter correction value: C2

2nd to-be-printed magenta letter correction value: M2

2nd to-be-printed yellow letter correction value: Y2

3rd to-be-printed black letter correction value: K3

3rd to-be-printed cyan letter correction value: C3

3rd to-be-printed magenta letter correction value: M3

3rd to-be-printed yellow letter correction value: Y3

4th to-be-printed black letter correction value: K4

4th to-be-printed cyan letter correction value: C4

4th to-be-printed magenta letter correction value: M4

4th to-be-printed yellow letter correction value: Y4

5th to-be-printed black letter correction value: K5

5th to-be-printed cyan letter correction value: C5

5th to-be-printed magenta letter correction value: M5

5th to-be-printed yellow letter correction value: Y5

6th to-be-printed black letter correction value: K6

6th to-be-printed cyan letter correction value: C6

6th to-be-printed magenta letter correction value: M6

6th to-be-printed yellow letter correction value: Y6

Any of above listed K1 through Y6 typically takes a numerical value between 0 and 255.

As described above, this embodiment can regulate not only the position for forming a toner image that corresponds to a long-sized sheet but also the position for forming a toner image that corresponds to a short-sized sheet. Thus, in an image forming apparatus according to the invention that can form toner images for two pages on the transfer surface of an intermediate transfer body, the correction values corresponding to the first sheet in the first image forming cycle (K3, C3, M3, Y3), the correction values corresponding to the second sheet in the first image forming cycle (K4, C4, M4, Y4) and the correction values corresponding to an odd numbered sheet in the second image forming cycle (K5, C5, M5, Y5) and the correction values corresponding to an even numbered sheet in the second image forming cycle (K6, C6, M6, Y6) are predefined for short-sized sheets in addition to the correction values corresponding to the first sheet in the first image forming cycle (K1, C1, M1, Y1) and the correction values corresponding to the second sheet in the second image forming cycle (K2, C2, M2, Y2) for long-sized sheets in order to satisfactorily correct the positions for forming toner images.

Figure 2:
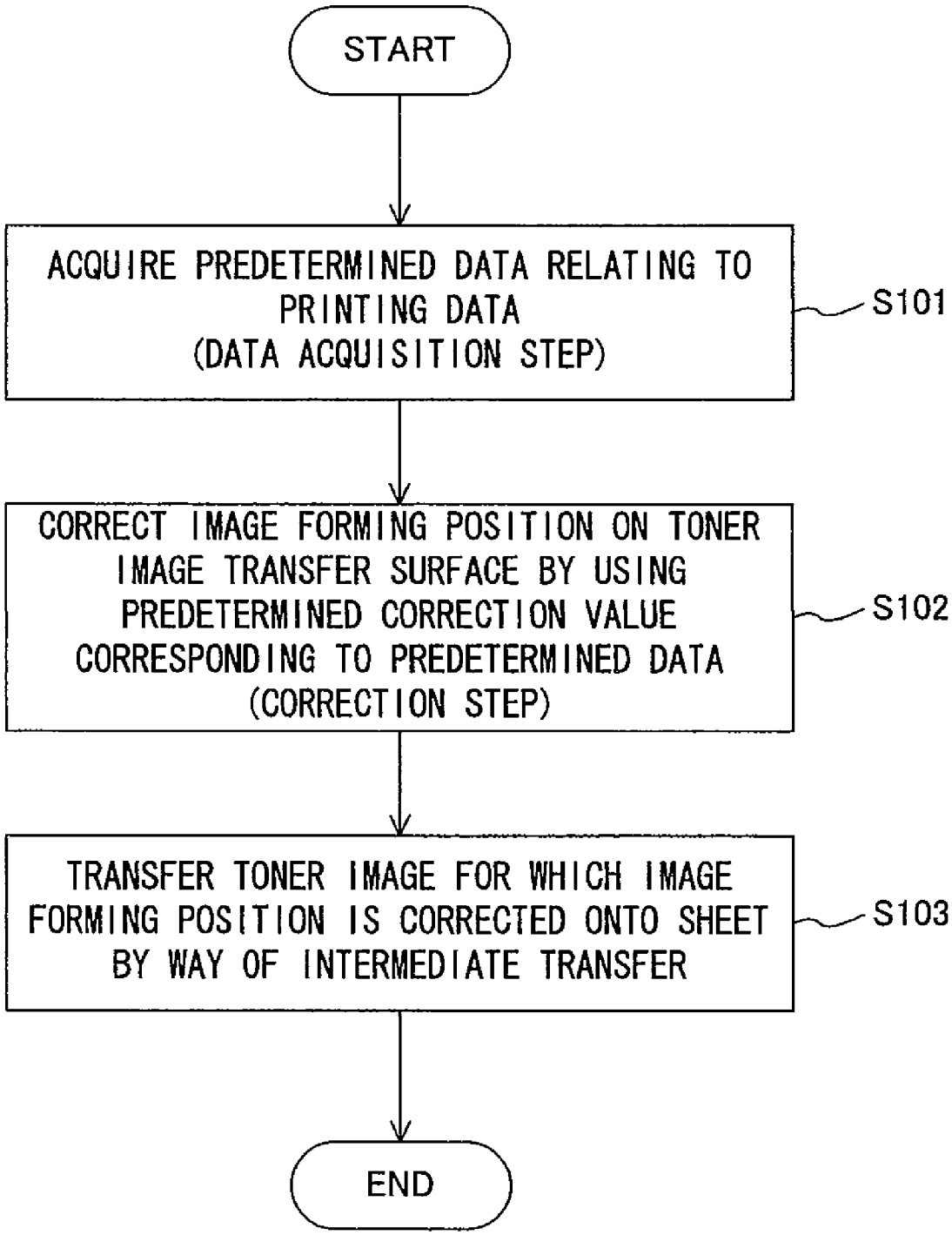
FIG. 2 is a flowchart illustrating the flow of operation of the embodiment of image forming apparatus of FIG. 1 (adapted to use an image forming method according to the invention)

FIG. 2 is a flowchart illustrating the flow of operation of the embodiment of image forming apparatus of FIG. 1 (adapted to use an image forming method according to the invention).

Referring to FIG. 2, the data acquisition section 101 acquires the predetermined data relating to the printing data for forming one or more than one images on a sheet (data acquisition step) (S101).

Then, if the correction section 102 determines that more than one toner images are to be formed simultaneously for a plurality of pages on the transfer surface according to the predetermined data, it corrects the predefined values for defining the positions for forming the toner images on the transfer surface, using the correction values corresponding respectively to the plurality of pages (the predetermined correction values that correspond to the predetermined data acquired in the data acquisition sep) (correction step) (S102).

Now, the operation of correcting the positions for forming toner image, using the predetermined correction values will be described in greater detail by referring to FIG. 3. The predetermined correction values are reflected to the operation of correcting the positions for forming the toner images by means of the computation formulas shown below. While only the method of correcting the positions for black (K) toner images are described below for the purpose of convenience, the same method can be applied when correcting the positions for toner images of the other colors (cyan, magenta and yellow).

The expression of an image forming cycle as used herein refers to a cycle of operation of forming a single color image in which the intermediate transfer belt is driven to make four full turns to sequentially transfer a black (K) image, a cyan (C) image, a magenta (M) image and a yellow (Y) image on the transfer surface. The expression of "the first image forming cycle" is used for printing the first page of A3 size or the first and second pages of A4 size, whereas the expression of "the second image forming cycle" is used for printing the second page of A3 size or the third and fourth images of A4 size. Similarly, the expression of "the third image forming cycle" and that of "the fourth image forming cycle" are used in a similar manner.

When printing an image on a long-sized sheet such as a sheet of A3 size (by transferring a single image from a transfer surface), the above-described predetermined correction values are reflected to the printing operation on the sheet by means of the computation formulas listed below (see the upper half of FIG. 3).

In the printing operation of the first image forming cycle, if K1−128=k(1), the correction value to be applied to the black printing operation of the first image forming cycle=k(1)=Ka.

In the printing operation of the second or any of the subsequent image forming cycles, if (K2−128)=k(2), the correction value to be applied to the black printing operation of the second or any of the subsequent image forming cycle=k(1)+k(2)=Kb.

Then, the position for forming the image is regulated by using the value as determined by means of the applicable one of the above formulas. While a reference value of "128" is used for the above computation formulas and if the applicable correction value is larger or smaller than the reference value is determined in the above description, the reference value that can be used for the purpose of the present invention is by no means limited to "128" and the numerical values that are computationally determined by referring to the reference value may be stored in the database 2 in advance as predetermined correction values.

If the value that is determined by means of the above computation formulas is "not larger than −1", the printing operation starting position (the position from which a laser beam scanning operation is started in the sheet conveying direction on the photosensitive surface) is shifted toward the leading end of the sheet (the downstream side in the direction of moving the photosensitive surface) from the currently defined printing starting position by the determined value× 0.042 [mm].

If the value determined by means of the above computation formulas is equal to "0", it means that it is not necessary to correct the predefined position for forming the toner image so that the correction section 102 does not correct the position for forming the toner image at all.

If the value determined by means of the above computation formulas is "not smaller than +1", the printing operation starting position (the position from which a laser beam scanning operation is started in the sheet conveying direction on the photosensitive surface) is shifted toward the tail end of the sheet (the upstream side in the direction of moving the photosensitive surface) from the currently defined printing starting position by the determined value×0.042 [mm].

On the other hand, when printing an image on a short-sized sheet such as a sheet of A4 size (by transferring a plurality of images from a transfer surface), the above-described predetermined correction values are reflected to the printing operation on the sheet by means of the computation formulas listed below (see the lower half of FIG. 3).

In the printing operation of the first image forming cycle, if (K3−128)=k(3) and (K4−128)=k(3), the correction value to be applied to the black printing operation of the first sheet of A4 size $=k(1)+k(3)=Kc$ and the correction value to be applied to the black printing operation of the second sheet of A4 size $=k(1)+k(3)+k(4)=kd.$ In the printing operation of the second or any of the subsequent image forming cycles, if (K5−128)=k(5) and (K6−128)=k(6), the correction value to be applied to the black printing operation of the third or any of the subsequent odd numbered sheet $=k(1)+k(2)+k(3)+k(5)=Ke$ and the correction value to be applied to the black printing operation of the fourth or any of the subsequent even numbered sheet of A4 size $=k(1)+k(2)+k(3)+k(4)+k(5)+k(6)=Kf.$ The method of regulating the printing operation starting position (the position from which a laser beam scanning operation is started in the sheet conveying direction on the photosensitive surface) according to the value determined by using the above-described computation formulas is same as the one described above for long-sized sheets. Thus, when forming toner images of a plurality of pages simultaneously on the transfer surface of an intermediate transfer body, predetermined correction values are assigned respectively to the plurality of pages so that it is now possible to accommodate the displacement of the position for forming a toner image on each page and correct the position for forming a toner image on each of the pages starting from the second page of the plurality of pages.

According to the command from the correction section 102, the image forming section 103 transfers the toner image onto a sheet as the toner image is formed at a corrected position on the transfer surface by regulating the timing of scanning the photosensitive surface of the photosensitive body by means of a laser beam to regulate the position of the electrostatic latent image (S103).

Each of the steps of the process (image forming method) taken by the above-described image forming apparatus is carried out as the image forming program stored in the memory 104 is executed by the CPU 105.

While the image forming apparatus of this embodiment is provided in advance with the functional features for carrying out the present invention in the above description, the present invention is by no means limited to such an arrangement and the functional features may alternatively be downloaded from a network or installed from a recording medium that stores them. Any recording mediums that can readably store computer programs can be used for the purpose of the present invention. Examples of such recording mediums include CD-ROMs. The functional features that are acquired as a result of installing them in advance or downloading them from a network may be so designed that they are realized only when they cooperate with the OS (operating system) of the apparatus.

The computation formulas for obtaining correction values as described above are defined according to the rules described below.

Figure 3:
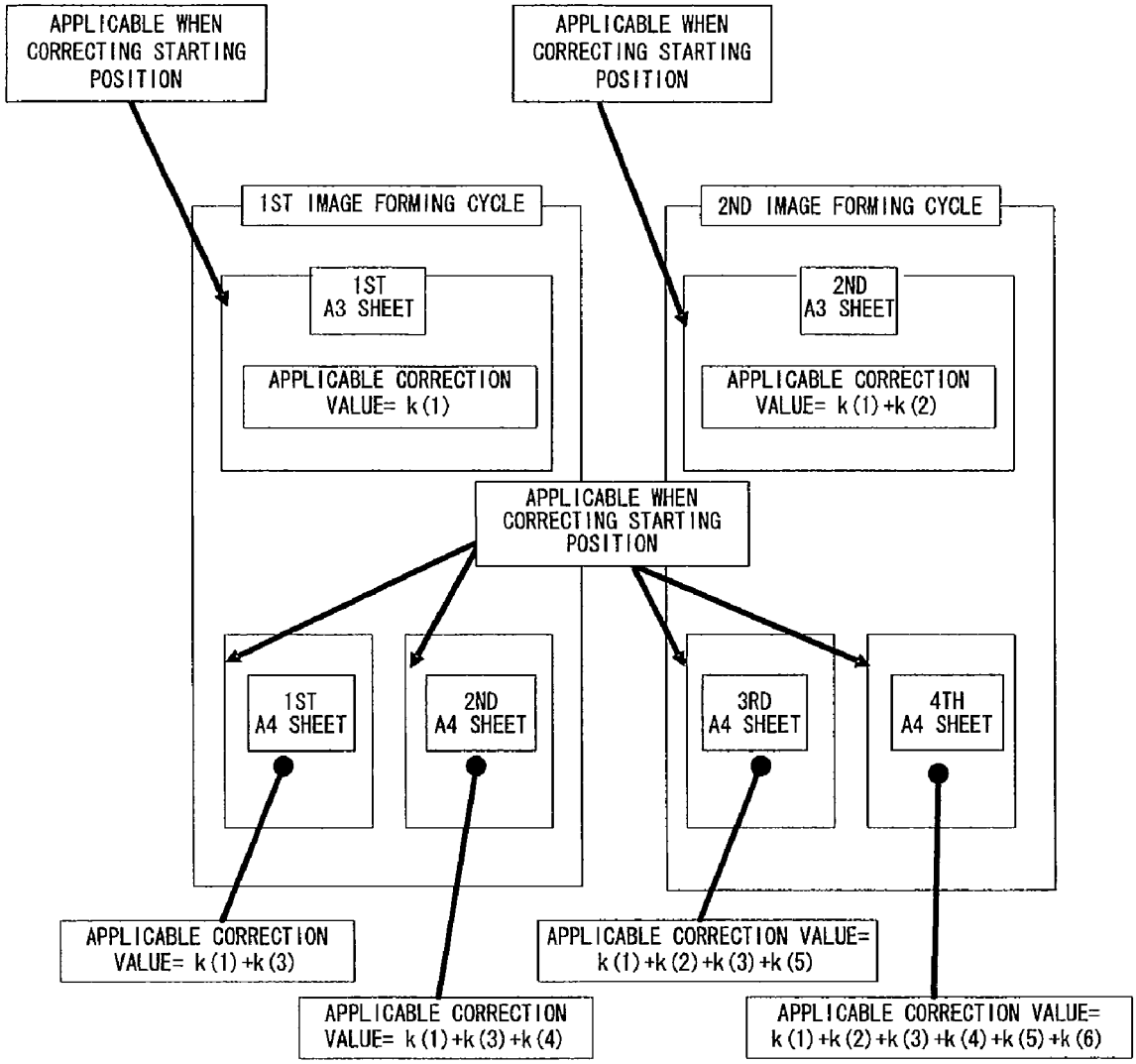
FIG. 3 is a schematic illustration of an operation of correcting the positions for forming toner images, using predetermined correction values.
Figure 4:
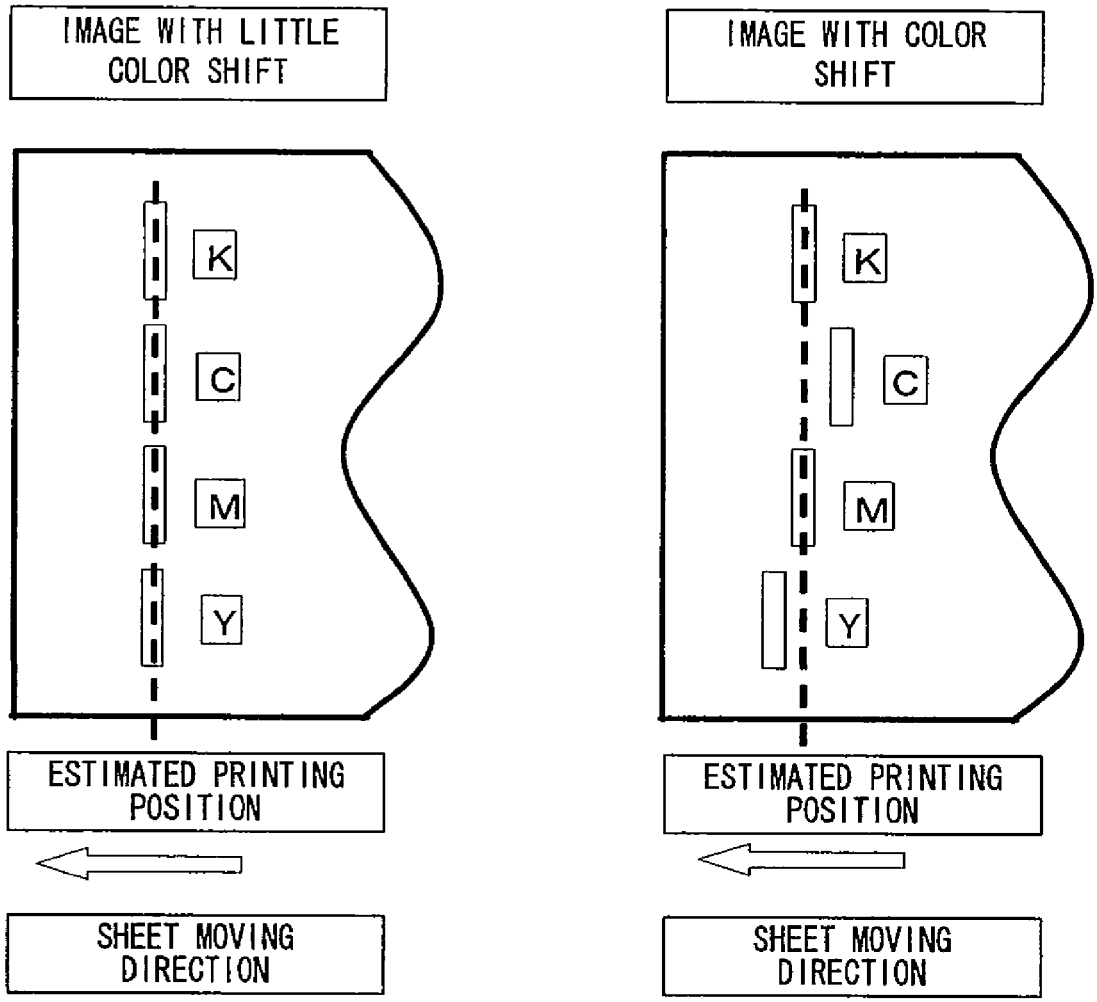
FIG. 4 is a schematic illustration of a so-called color shift.
Figures 5, 6:
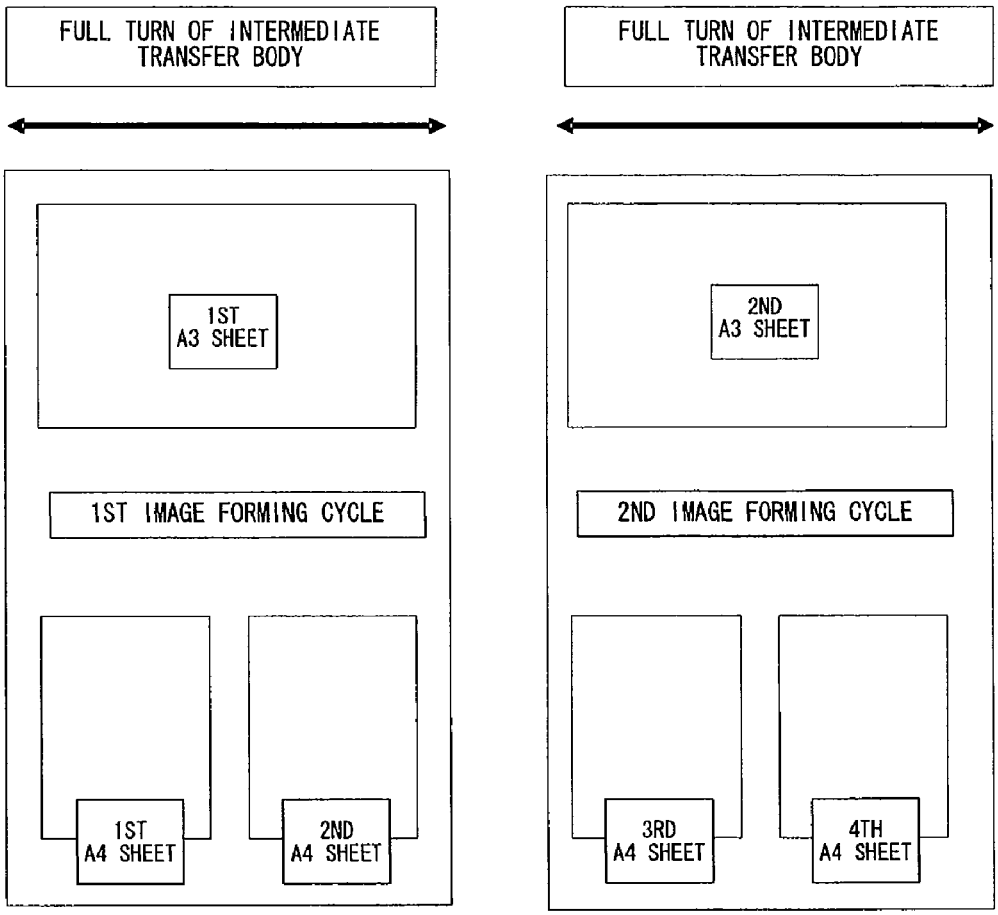
FIG. 5 is a schematic illustration of a method of forming toner images corresponding to long-sized sheets and toner images corresponding to short-sized sheets.
FIG. 6 is a schematic illustration of an example of classification of sheet sizes for a group of sheet sizes for which toner images are formed simultaneously on an intermediate transfer body for two pages and a group of sheet sizes for which only a toner image is formed on an intermediate transfer body for a single page.
Figure 7:
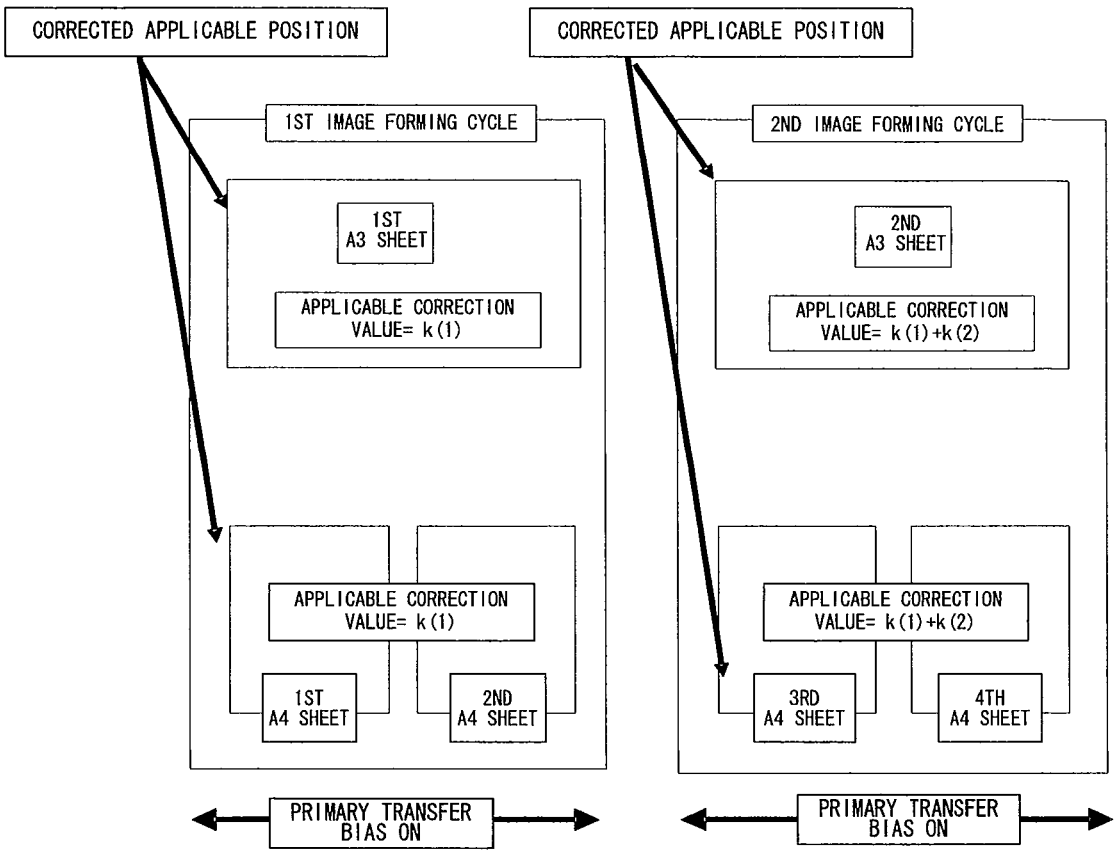
FIG. 7 is a schematic illustration of a conventional method of correcting the positions for forming toner images on the transfer surface of an intermediate transfer body for short-sized sheets of paper and also for long-sized sheets of paper.
Figure 8:
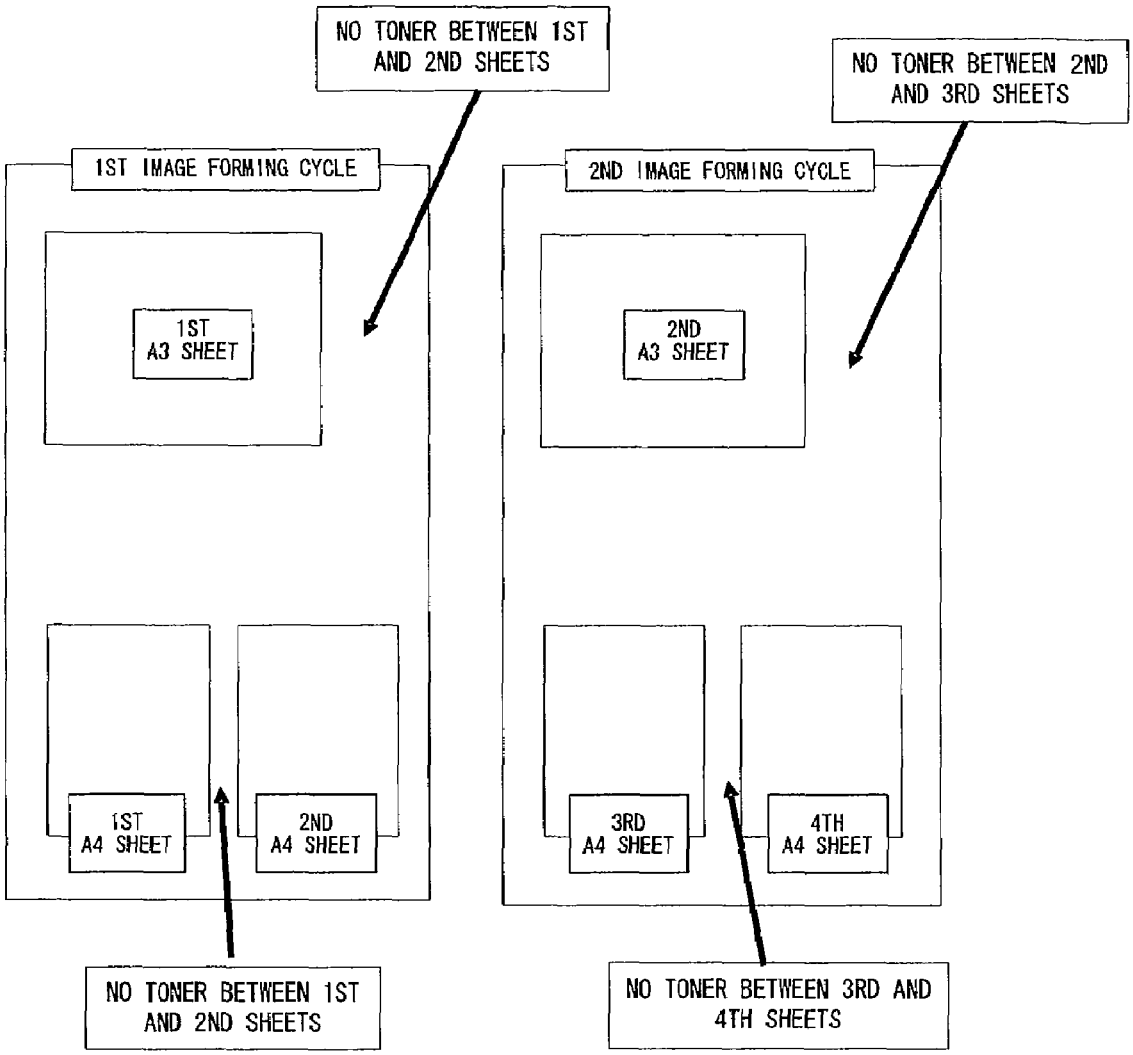
FIG. 8 is a schematic illustration of the differences between an operation of forming toner images corresponding to long-sized sheets on a transfer surface and an operation of forming toner images corresponding to short-sized sheets on a transfer surface.

As for short-sized sheets such as A4 size sheet, the correction value Kc of the first A4 sheet and the correction value Kd of the second A4 size include the correction value Ka of the first A3 sheet that belongs to the same first image forming cycle (refer to the above description and FIG. 3).

Additionally, the correction value Ke of the third A4 sheet and the correction value Kf of the fourth A4 sheet include the correction value Kb of the second A3 sheet that belongs to the same second image forming cycle (refer to the above description and FIG. 3).

In other words, when forming toner images for a plurality of pages simultaneously on a transfer surface, the correction value of any arbitrarily selected page of the plurality of pages whose images are formed on the transfer surface simultaneously is so defined as to include the correction value of the page for which a toner image is formed immediately before the toner image of the arbitrarily selected page is formed.

This means that the role of the value to be used for regulating the influence of the displacement of the position for forming a toner image that is attributable to the difference of image forming cycle is so determined as to be included in correction values Ka, Kb in advance. With this arrangement, for example, if the influence of electrostatic adsorption that is attributable to the blank space separating two toner images as described above is small, the operation of regulating a toner image forming position that is specifically designed for short-sized sheets can be omitted or limited to an operation of fine adjustment. Additionally, the above principle may be so utilized that, when correcting the position for forming a toner image corresponding to an arbitrarily selected page, the correction value that is used for the page immediately preceding the arbitrarily selected page may be used to simplify the image forming position regulating operation and/or limit it to an operation of fine adjustment.

When the positions for forming toner images are regulated by a service person, he or she typically regulates the positions on long-sized (e.g., A3) sheets first and then regulates the positions on short-sized sheets. Thus, the present invention can alleviate the load of the service person when the predetermined correction values are defined in the above-described manner. As for the sequence of operation of regulating the positions for forming toner images, it is efficient to do the operation in the order of the first long-sized sheet, the second long-sized sheet, the first short-sized sheet, the second short-sized sheet, the third short-sized sheet, the fourth and subsequent short-sized sheets, although this is by no means compulsory.

As described above, with this embodiment, since the positions for forming toner images on a transfer surface can be regulated for even numbered pages on short-sized sheets such as A4 sheets (when images of two images are formed simultaneously), it is now possible to form images on short-sized sheets with a little color shift, if any, to dissolve the problem of serious color shifts of the conventional techniques.

Additionally, the operation of regulating the positions for forming toner images for short-sized sheets is conducted only when the influence of electrostatic adsorption that is attributable to the blank space between two sheets for which no toner image is formed is large. In other words, the operation is omitted or only an operation of fine adjustment is conducted when the influence is small to improve the processing efficiency and alleviating the computational load.

While the present invention is described above by way of a specific embodiment, it may be clear to those skilled in the art that the present invention is by no means limited thereto and the above-described embodiment may be modified and/or altered in various different ways without departing from the spirit and scope of the present invention.

What is claimed is:

1. An image forming apparatus comprising:

an image carrier is configured to carry long toner images corresponding to a sheet having a first size in a direction, and to simultaneously carry short toner images corresponding to a sheet having a second size shorter than the first size in the direction;

an image forming device configured to form toner images on the image carrier, the toner images being different from each other in color;

a storage device configured to store correction values to correct relative position of the toner images, respectively; and a correction device configured to correct a forming position of the long toner image on the image carrier by a first correction value, and configured to correct a forming position of the short toner image by a second correction value different from the first correction value.

2. The apparatus of claim 1, wherein the image forming device forms a first long toner image on the image carrier in a first rotation of the image career, and forms a second long toner image on the image carrier in a second rotation of the image career subsequent to the first rotation.

3. The apparatus of claim 1, wherein the image forming device forms a first short toner image on the image carrier in a first rotation of the image carrier, forms a second short toner image subsequent to the first short toner image on the image carrier in the first rotation, forms a third short toner image on the image carrier in a second rotation subsequent to the first rotation of the image carrier, and forms a fourth short toner image subsequent to the third short toner image on the image carrier in the second rotation.

4. The apparatus of claim 1, wherein the image carrier is configured to carry two short toner images including a first toner image and a second toner image respectively corresponding to a sheet having the second size shorter than the first size in the direction.

5. The apparatus of claim 4, wherein the image carrier is configured to simultaneously carry the two short toner images.

6. The apparatus of claim 5, wherein image forming device forms the second toner image subsequent to the first toner image.

7. The apparatus of claim 6, wherein the correction device corrects a forming position of the second toner image by the second correction value.

8. The apparatus of claim 7, wherein the correction device corrects a forming position of the first toner image by a third correction value different from the second correction value.

9. The apparatus of claim 8, wherein the third correction value is a sum of the first correction value and a second adjustment value, and the second correction value is a sum of the first correction value, a first adjustment value and a second adjustment value.

10. The apparatus of claim 2, wherein the image carrier is configured to simultaneously carry the first short toner image and the second short toner image respectively corresponding to the sheet having the second size in the direction.

11. The apparatus of claim 10, wherein the correction device corrects a forming position of the second short toner image by the second correction value, corrects a forming position of the first short toner image by a third correction value different from the second correction value, corrects a forming position of the third short toner image by a fourth correction value, corrects a forming position of the fourth short toner image by a fifth correction value, and corrects a forming position of the second long toner image by a sixth correction value.

12. The apparatus of claim 11, wherein the third correction value is a sum of the first correction value and a second adjustment value, the second correction value is a sum of the first correction value, a first adjustment value and the second adjustment value, the fourth correction value is a sum of the first correction value, the second adjustment value, a third adjustment value and a fourth adjustment value, the fifth correction value is a sum of the first correction value, the first adjustment value, the second adjustment value, the third adjustment value, the fourth adjustment value and a fifth adjustment value, and the sixth correction value is a sum of the first correction value and the third adjustment value.

* * * * *

UNITED STATES PATENT AND TRADEMARK OFFICE

CERTIFICATE OF CORRECTION

PATENT NO. : 7,697,018 B2
APPLICATION NO. : 11/380896
DATED : April 13, 2010
INVENTOR(S) : Shishikura It is certified that error appears in the above-identified patent and that said Letters Patent is hereby corrected as shown below:

Column 10, line 59: replace "career" with --carrier--.

Column 10, line 61: replace "career" with --carrier--.

Signed and Sealed this

Eighteenth Day of May, 2010

David J. Kappos

David J. Kappos
*Director of the United States Patent and Trademark Office*